United States Patent [19]

Rutzen et al.

[11] Patent Number: 4,832,856

[45] Date of Patent: May 23, 1989

[54] AQUEOUS FABRIC SOFTENER FOR THE TREATMENT OF FABRICS: CONTAINING ALKYLAMINE, HYDROXYALKYLAMINE OR QUATERNARY AMMONIUM DERIVATIVE AND A CARBOXYLIC ACID

[75] Inventors: Horst Rutzen, Langenfeld; Eric Sung, Monheim, both of Fed. Rep. of Germany

[73] Assignee: Henkel Kommanditgesellschaft auf Aktien, Duesseldorf, Fed. Rep. of Germany

[21] Appl. No.: 166,360

[22] Filed: Mar. 10, 1988

[30] Foreign Application Priority Data

Mar. 13, 1987 [DE] Fed. Rep. of Germany ..... 3708132

[51] Int. Cl.[4] ..... C11D 1/40; C11D 3/20

[52] U.S. Cl. ..... 252/8.8; 252/8.6; 8/137

[58] Field of Search ..... 252/8.8

[56] References Cited

U.S. PATENT DOCUMENTS

| | | | |
|---|---|---|---|
| 4,308,024 | 12/1981 | Wells | 8/137 |
| 4,446,042 | 5/1984 | Leslie | 252/8.75 |
| 4,460,485 | 7/1984 | Rapisarda et al. | 252/8.75 |
| 4,555,349 | 11/1985 | Butterworth et al. | 252/8.6 |
| 4,780,452 | 10/1988 | Krenitsky et al. | 514/45 |

FOREIGN PATENT DOCUMENTS 226932 7/1987 European Pat. Off. .

*Primary Examiner*—A. Lionel Clingman

*Attorney, Agent, or Firm*—Ernest G. Szoke; Wayne C. Jaeschke; Real J. Grandmaison

[57] ABSTRACT

Fabric softeners intended for the treatment of fabrics after washing are disclosed. These softeners contain as active substance a combination of carboxylic acids and amines and/or quaternary ammonium compounds containing a long chain alkyl or alkenyl radical and comprise:

(a) one or more amines corresponding to general formulae (I) and/or (II) below:

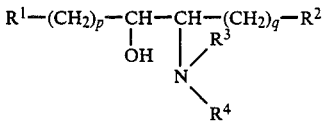

(I)

$R^1R^3R^4N$ (II)

in which:

$R^1$ and $R^2$ may be the same or different and, independently of one another, represent hydrogen, straight-chain or branched $C_1$–$C_{20}$ alkyl radicals, in addition to which $R^2$ may represent a hydroxy group or a group corresponding to the following formula:

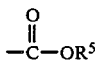

(III)

where:

$R^5$ is hydrogen or a straight-chain or branched $C_1$–$C_6$ alkyl radical; and $R^3$ and $R^4$ may be the same or different and, independently of one another, represent hydrogen, staight-chain or branched $C_1$–$C_6$ alkyl radicals or hydroxyalkyl radicals containing from 1 to 6 carbon atoms in the straight-chain alkyl radical; and p and q are numbers of from 0 to 22, the sum (p+q) being in the range of 0 to 22;

and/or one or more ammonium compounds derived from such amines by quaternization;

(b) one or more straight-chain or branched, saturated or unsaturated $C_114$ $C_{24}$ carboxylic acids; and (c) optionally, other substances typically used in fabric softeners.

This active-substance combination is readily and inexpensively available and provides the treated fabrics with a soft, full feel.

19 Claims, No Drawings

AQUEOUS FABRIC SOFTENER FOR THE TREATMENT OF FABRICS: CONTAINING ALKYLAMINE, HYDROXYALKYLAMINE OR QUATERNARY AMMONIUM DERIVATIVE AND A CARBOXYLIC ACID

BACKGROUND OF THE INVENTION

This invention relates to fabric softeners which may be used for the treatment of fabrics after washing.

"Fabric softeners" are normally understood to be preparations formulated or designed for formulation in water and containing one or more active substances which are used in detergents and cleaning preparations to provide fabrics with a soft feel. Preparations of the type in question normally contain one or more cationic surfactants which are capable of imparting a soft feel to fabrics treated with them. Cationic surfactants which have been proposed for this purpose include, in particular, water-insoluble quaternary ammonium compounds in which the ammonium nitrogen atom must contain at least two long-chain $C_{16}$–$C_{18}$ alkyl radicals or at least one overlong radical, for example containing from 32 to 36 carbon atoms, to ensure that the fabric softener has adequate softening properties. Quaternary ammonium compounds such as these have been produced in large quantities, generally by elaborate processes, specifically for the production of fabric softeners.

In U.S. Pat. No. 4,308,024, it is proposed to use long-chain alkyl or alkenyl monocarboxylic acids in addition to water-insoluble cationic surfactants of the type in question in order considerably to improve the softening effect of a fabric softener. However, one of the disadvantages of state-of-the-art preparations of this type lies in the elaborate sythesis of the water-insoluble quaternary ammonium compounds containing at least two long-chain alkyl radicals.

An object of the present invention is to avoid the disadvantages known from the prior art, more especially the use of fabric softener constituents prepared by elaborate syntheses, and to provide fabric softeners of which the active substances may be prepared by simple chemical syntheses from inexpensive raw materials or from intermediate products capable of synthesis on a large scale. It has surprisingly been found that fabric softeners having a good fabric softening effect can be obtained simply by mixing certain fatty acids and fatty amines or corresponding quaternary ammonium compounds of the fatty amines which may be inexpensively obtained on a large scale from natural raw materials by simple oleochemical syntheses.

SUMMARY OF THE INVENTION

The present invention relates to an aqueous fabric softener composition based on a combination of carboxylic acids and amines and/or quaternary ammonium compounds, comprising:

(a) one or more amines corresponding to general formulas (I) and/or (II) below:

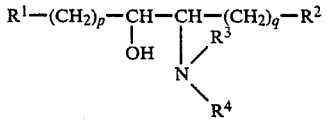

(I)

-continued $$R^1R^3R^4N \qquad \text{(II)}$$

in which:

$R^1$ and $R^2$ may be the same or different and, independently of one another, represent hydrogen, straight-chain or branched $C_1$–$C_{20}$ alkyl radicals, in addition to which $R^2$ may represent a hydroxy group or a group corresponding to the following formula:

$$-\overset{\overset{\displaystyle O}{\|}}{C}-OR^5 \qquad \text{(III)}$$

where:

$R^5$ is hydrogen or a straight-chain or branched $C_1$–$C_6$ alkyl radical; and $R^3$ and $R^4$ may be the same or different and, independently of one another, represent hydrogen, straight-chain or branched $C_1$–$C_6$ alkyl radicals or hydroxyalkyl radicals containing from 1 to 6 carbon atoms in the straight-chain alkyl radical; and p and q are numbers of from 0 to 22; the sum (p+q) being in the range of 0 to 22;

and/or one or more ammonium compounds derived from such amines by quaternization;

(b) one or more straight-chain or branched, saturated or unsaturated $C_1-C_{24}$ carboxylic acids; and (c) optionally, other substances typically used in fabric softeners.

DETAILED DESCRIPTION OF THE INVENTION

The fabric softeners according to the invention may contain a number of amino compounds corresponding to general formulae (I) and (II) set forth above as the amine component. In addition, one or more ammonium compounds derived from amines corresponding to general formulae (I) and/or (II) by quaternization may also be used as "amine component" together with or instead of the above-mentioned amines corresponding to general formulae (I) and/or (II).

In addition to hydrogen, therefore, $R^1$ and $R^2$ independently of one another represent alkyl radicals such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl and eicosyl, and also includes branched homologs of such alkyl radicals. According to the invention, $R^2$ may also be a hydroxy group or a group of the formula:

$$-\overset{\overset{\displaystyle O}{\|}}{C}-OR^5 \qquad \text{(III)}$$

in which $R^5$ is hydrogen or an alkyl radical such as methyl, ethyl, n-propyl, i-propyl, n-butyl, i-butyl, t-butyl, n-pentyl, the homologous pentyl radicals isomeric to n-pentyl, n-hexyl and the branched-chain hexyl radicals isomeric to n-hexyl.

In addition to hydrogen, $R^3$ and $R^4$ may also be straight-chain or branched $C_1$–$C_6$ alkyl radicals such as methyl, ethyl, n-propyl, i-propyl, n-butyl, i-butyl, t-butyl, n-pentyl, n-hexyl and also the branched pentyl and hexyl radicals isomeric to the straight-chain pentyl and hexyl radicals. In addition, $R^3$ and $R^4$ in general formulae (I) and (II) may also represent hydroxyalkyl radicals in which the alkyl groups are always linear, i.e., methyl, ethyl, propyl, butyl, pentyl and hexyl groups.

In general formula (I) above, the indices p and q represent numbers in the range from 0 to 22, the sum (p+q) always being in the range from 0 to 22. In this connection, p and q may represent every possible number in the range mentioned, including fractional numbers because, as explained hereinafter, it is also possible to use mixtures of compounds in which there is a different number of $—CH_2—$ groups in the molecule and the indices p and q only represent the mean numerical values. Through the accumulation of mixtures of compounds in different proportions within a mixture, fractional numbers are also possible as indices for p and q.

In accordance with the foregoing observations, a large number of compounds which correspond to general formulae (I) and (II) or which are derived from such compounds by quaternization may be used as the amine component for the fabric softeners according to the invention. In preferred embodiments of the invention, suitable amines corresponding to general formula (I) may be divided into several groups. Thus, one or more compounds corresponding to general formula (I), in which $R^1$ and $R^2$ represent hydrogen and $R^3$ and $R^4$ independently of one another represent straight-chain or branched $C_1$–$C_6$ alkyl radicals or hydroxyalkyl radicals containing from 1 to 6 carbon atoms in the alkyl radicals, may be preferably used as the amine component. Compounds of this class are amines which may be produced on an industrial scale from olefins via an epoxidation step. The resulting olefin epoxides are then reacted with secondary amines corresponding to the following general formula:

$R^3R^4NH$ in accordance with reaction equation (1) below, in which casae the above-mentioned preferred amines corresponding to general formula (I) are formed.

Reaction equation (1):

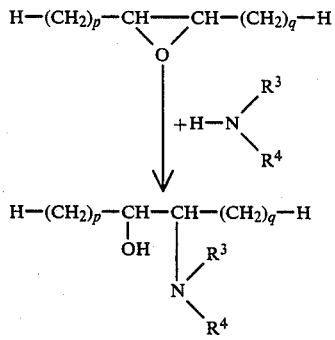

(Formula 1, where $R^1 = R^2 = H$)

In another preferred embodiment, the fabric softeners according to the invention contain one or more amines corresponding to general formula (I), in which $R^1$ and $R^2$ represent hydrogen, $R^3$ and $R^4$ independently of one another represent straight-chain $C_1$–$C_3$ alkyl radicals or hydroxyalkyl radicals containing from 1 to 3 carbon atoms in the alkyl radical, q is 0 and p is a number of from 8 to 18. Particularly preferred amines corresponding to general formula (I) are those in which $R^1$ and $R^2$ represent hydrogen, $R^3$ and $R^4$ independently of one another represent methyl or ethyl radicals or hydroxyethyl radicals, q is 0 and p is a number of from 10 to 16. Particularly preferred amines within this group are produced in accordance with reaction equation (1) above from $C_6$–$C_{24}$ olefin epoxides (p is 0 to 10, q is 0 to 12, $R^1 = R^2 = H$) and dimethylamine or diethylamine or methyl ethanolamine or diethanolamine, and give amines corresponding to general formula (I) which have particularly good fabric softening properties, i.e. provide fabrics with a soft feel and pleasant fluffiness.

In another preferred embodiment, the fabric softeners contain one or more amines corresponding to general formula (I), in which $R^1$ represents hydrogen or straight-chain or branched $C_1$–$C_{20}$ alkyl radicals and $R^2$ is a hydroxy group or a group corresponding to the following formula:

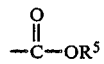

(III)

where $R^5$ is hydrogen or a straight-chain or branched $C_1$–$C_6$ alkyl radical. Amines such as these are formed in accordance with reaction equation (2) below from epoxidized fatty acids, fatty acid esters or fatty alcohols which may be inexpensively obtained in large quantities from animal or vegetable fats or oils, i.e. from natural sources, and which may be used not only individually, but also in the form of mixtures resulting from the natural sources. Mixtures such as these comprise not only mixtures of compounds of different chain length of the type which occur in natural fats and oils (as homologs of otherwise identical structure), but also mixtures of compounds which bear epoxide groups at different places in the molecular chain and hence also lead differently through the reaction with the corresponding amines to mixtures of ring-opening products corresponding to general formula (I). The product mixtures corresponding to general formula (I) resulting from reaction equation (2) are suitable as amine component of the fabric softeners according to the invention.

Reaction equation (2):

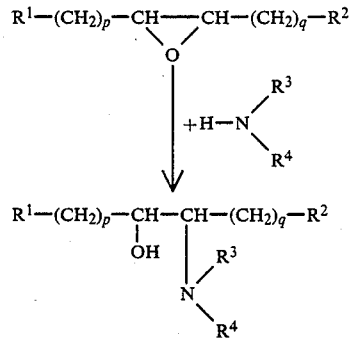

In particularly preferred embodiments, the fabric softeners contain one or more amines corresponding to general formula (I), in which $R^1$ is a straight-chain or branched $C_1$–$C_{20}$ alkyl radical and $R^2$ is a hydroxy group or a group corresponding to the following formula:

$$-\overset{\overset{\displaystyle O}{\|}}{C}-OR^5 \qquad \text{(III)}$$

where $R^5$ has the meanings defined above, and $R^3$ and $R^4$ independently of one another represent straight-chain or branched $C_1$–$C_6$ alkyl radicals or hydroxyalkyl radicals containing from 1 to 6 carbon atoms in th e linear alkyl chain. Among such compounds corresponding to general formula (I), those in which $R^1$ is a straight-chain $C_1$–$C_3$ alkyl radical, $R^2$ is a carbonyloxymethyl group and $R^3$ and $R^4$ independently of one another represent hydrogen, straight-chain or branched $C_1$–$C_6$ alkyl radicals or hydroxyalkyl radicals containing from 1 to 6 carbon atoms in the linear alkyl radical, are particularly suitable as amine components for fabric softeners according to the invention. This is mainly because fabric softeners containing amine components such as these are capable of providing the fabrics washed with them with the desired fluffiness and with a soft feel. In this connection, it can also be of advantage in accordance with the invention, wqhere $R^1$ and $R^2$ have the same meanings as defined above, for the substituents $R^3$ and $R^4$ in the general formula (I) of the amine or amines used to be selected from the group consisting of straight-chain $C_1$ –$C_3$ alkyl radicals and hydroxyalkyl radicals containing from 1 to 3 carbon atoms in the linear alkyl radicals, in which case p is 8 to 18 and q is 0. Among these compounds, those in which $R^3$ and $R^4$ in general formula (I) represent methyl or ethyl radicals or hydroxyethyl radicals, p is 10 to 16 and q is 0 are preferred by virtue of their particularly favorable fabric-softening p is 10 to 16 and q is 0 are preferred by virtue of their particularly favorable fabric-softening properties.

In the fabric softeners according to the invention, amines corresponding to the following general formula:

$$R^1R^3R^4N \qquad \text{(II)}$$

may be used in addition to or instead of one or more amines corresponding to general formula (I). In general formula (II), $R^1$ may represent hydrogen, straight-chain or branched $C_1$–$C_{20}$ alkyl radicals of the type already mentioned and $R^3$ and $R^4$ may be the same or different and, independently of one another, may represent hydrogen, straight-chain or branched $C_1$–$C_6$ alkyl radicals or hydroxyalkyl radicals containing from 1 to 6 carbon atoms in the linear alkyl radical. The radical $R^1$ in general formula (II) normally contains from 12 to 20 and preferably from 14 to 18 carbon atoms. Amines having chain lengths in this preferred range may be conveniently synthesized from natural fats and oils by methods known per se. Because of the synthesis methods normally used, mixtures of amines having different chain lengths which may readily be used as an amine component in the fabric softeners according to the invention are generally obtained on an industrial scale. However, it is also possible to synthesize individual compounds and to use them as amine component in the fabric softeners. Among the group of amines corresponding to general formula (II) mentioned above, laurylamine, cetylamine, lauryldimethylamine and cetyldimethylamine have been used particularly successfully in practice. Where amine mixtures of native fats or oils are used, coconut dimethylamine ($R^1$ is $C_{12}$–$C_{18}$) or tallow alkyldimethylamine ($R^1$ is $C_{16}$–$C_{18}$) are particularly suitable.

As mentioned above, another equally preferred embodiment of the invention is characterized by the use of one or more ammonium compounds derived by quaternization from amines corresponding to general formulae (I) and (II) as the amine component. These quaternized amines may be used alone or in admixture with one or more of the above-mentioned amines corresponding to general formulae (I) and (II). Ammonium compounds such as these may be used both as individual components and also in the form of mixtures of several ammonium compounds. It does not matter in which molar ratio they are mixed with the above-mentioned amines corresponding to general formulae (I) and (II) or in which molar ratios to one another they are present in the fabric softeners according to the invention. Such ammonium compounds are prepared by quaternization of the above-mentioned amines corresponding to general formulae (I) and (II) with a compound corresponding to the following general formula:

$$(R^6)_mX \qquad \text{(IV)}$$

in which:

$R^6$ represents straight-chain or branched $C_1$–$C_4$ alkyl radicals or phenalkyl radicals containing 1 or 2 carbon atoms in the alkyl radical;

X is an acid residue; and m is the valency of the acid residue X.

These ammonium compounds are used with advantage in addition to or instead of the amines corresponding to general formulae (I) and/or (II).

Accordingly, suitable alkyl radicals $R^6$ in the quaternizing agent are alkyl radicals selected from the group consisting of methyl, ethyl, n-propyl, i-propyl, n-butyl, i-butyl, or t-butyl or phenalkyl radicals selected from the group consisting or benzyl or phenethyl. X may represent the acid residue of a number of organic and inorganic acids, such as chloride, bromide, methosulfate, ethosulfate and toluene sulfate.

Where ammonium compounds are used, particularly preferred are those derived from the compounds corresponding to general formulae (I) and (II) by quaternization with a quaternizing agent such as methyl chloride, ethyl chloride, benzyl chloride and dimethylsulfate.

The reaction in which the amines corresponding to general formulae (I) and (II) are quaternized with the quaternizing agents referred to above is known as such, and generally comprises reacting the particular amines with the desired quaternizing agent at elevated temperature in the presence or absence of a solvent.

In another embodiment of the invention, the quaternization reaction may also be carried out as known from the prior art by reacting the particular amine with an alkylene oxide, preferably with ethylene oxide, in the presence of an acid which gives quaternization products containing a hydroxyalkyl group instead of the hydrogen atom in the amine. The number of carbon atoms in the alkyl chain correspond to the number of carbon atoms of the alkylene oxide used for the reaction, and the statistical number of the alkyl groups is a direct function of the molar ratio of alkylene oxide to amine established during the reaction. The quaternary ammonium compounds obtained in this way contain as anion X the acid residue of the acid used for the reaction. For example, the anion X may be a chloride, sulfate, acetate, lactate, phosphate or benzoate anion.

The fabric softeners according to the invention, which contain one or more amines corresponding to general formula (I) or (II) or quaternary ammonium compounds derived therefrom as the amine component, contain one or more straight-chain or branched, saturated or unsaturated $C_1$–$C_{24}$ carboxylic acids as another essential component. Among the carboxylic acids mentioned, straight-chain carboxylic acids are preferably used as the carboxylic acid component. These straight-chain carboxylic acids may be saturated or unsaturated and normally contain from 1 to 24 and, in preferred embodiments, from 8 to 18 carbon atoms. Among these carboxylic acids, saturated straight-chain $C_8$–$C_{18}$ carboxylic acids are particularly preferred by virtue of their natural availability. Accordingly, the carboxylic acids include acids such as formic acid, acetic acid, propionic acid, butyric acid, valeric acid, caproic acid, oenanthic acid, caprylic acid, perlargonic acid, capric acid, undecanoic acid, lauric acid, tridecanoic acid, myristic acid, pentadecanoic acid, palmitic acid, margaric acid, stearic acid, nonadecanoic acid, arachic acid, uneicosanoic acid, behenic acid, tricosanoic acid and lignoceric acid. In these cases, too, it is possible to use individual compounds as the carboxylic acid component or mixtures of different carboxylic acids instead of individual compounds. As described above, mixtures such as these are obtained from naturally available sources, such as for example vegetable or animal fats or oils, by standard oleochemical syntheses, for example by saponification of such fats and oils.

In addition to straight-chain fatty acids, it is also possible to use fatty acids containing branched alkyl radicals having the same C-chain lengths which are prepared by known methods via oxoalcohols or oxoaldehydes or by the Koch-Haaf synthesis. Guerbet acids are also suitable as the carboxylic acid component, for example isopalmitic acid, which may be obtained from the corresponding Guerbet alcohols by oxidation or alkali fusion.

Natural fats and oils such as soybean oil, linseed oil, sunflower oil, coconut oil, palm oil and tallow, may also be used as the fatty acid component of the fabric softeners. These unsaturated fatty acids may be used either individually or in admixture wiht one another or with saturated fatty acids as the carboxylic acid component. By virtue of their ready availiability, carboxylic acids from the natural sources mentioned may be used with particular advantage.

The fabric softeners according to the invention normally contain the aforementioned amine components, i.e. amines corresponding to general formulae (I) and/or (II) and/or quaternary ammonium compounds derived therefrom by quaternization on the one hand and carboxylic acids on the other hand, in certain quantities. The quantity of amine component is normally in the range from 10 to 90 mole % while the quantities of carboxylic acids are normally in the range from 90 to 10 mole %. A molar ration of amine component to carboxylic acid component in the range from 0.75 : 1 to 4 : 1 is preferred, a molar ratio of 1 : 1 being particularly preferred.

The fabric softeners according to the invention contains water as another essential component. The quantities of amine component and carboxylic acid component constitute at least about 2% by weight of the aqueous fabric softener, preferably about 2 to 20% by weight.

In addition to the three essential components mentioned (amine component, carboxylic acid component and water), the fabric softeners may optionally contain other substances of the type typically used in fabric-softening preparations, including for example perfumes, coloring substances, solvents, preservatives and viscosity regulators. Substances such as these are normally present in the fabric softeners in quantities of from 0 to 50% by weight, based on the total weight of the fabric softener. However, their presence or absence does not affect the fabric-softening result.

The amine component, the carboxylic acid component and the other components, if any, present in the fabric softeners according to the invention are formulated in water. The quantities of water used are such that the formulation process gives easy-to-handle, low-viscosity fabric softeners which may readily be introduced in this form into the afterwash liquor. The quantities of water in the formulated fabric softeners according to the invention is normally in the range from about 98 to about 50% by weight.

The fabric softeners according to the invention are produced by methods known per se from the prior art. Their production essentially comprises mixing the individual components together in standard mixers, using a solvent if desired and at slightly elevated temperature. The solvents which may be used for the production of the fabric softeners are best selected so that they may remain in the fabric softener. Examples of suitable solvents are ethanol, n-propanol, i-propanol, ethylene glycol, propylene glycol, diglycols and polyglycols. Suitable concentrations depend largely on the particular case, i.e. on the miscibility of the amine component and the carboxylic acid component with water and may be selected within wide limits. Compatibility with water is an important criterion for the choice of the type and quantity of solvent used in the production of the fabric softeners.

The fabric softeners according to the invention obtained in this way are largely soluble in water or may be finely dispersed in water so that they show particularly high stability in storage. When used in liquors, they are normally employed in concentrations of from 0.1 to 0.6% by weight, based on the amine and carboxylic acid component, and show the desired softening result in this concentration range. They provide the fabrics treated with them with pleasant fluffiness and a soft feel which was judged by examiners to be extremely pleasant. The essential components used for the production of the fabric softeners according to the invention may be conveniently obtained on an industrial scale from inexpensively available, in some cases natural, sources. The production of the fabric softeners according to the invention does not require separation or purification of the individual components.

The invention is illustrated by the following Examples.

EXAMPLE 1

(a) Production of a fabric softener 40.06 g (0.20 mole) lauric acid and 43.41 g (0.20 mole) technical hexadecyl dimethylamine (molecular mass calculated from a.v.) were introduced into a 250 ml wide-necked flask and melted by heating on a steam bath with occasional stirring to form a homogeneous, yellowish liquid. A partially crystallizing product was formed on cooling. 10 g of this product dissolved clearly in a mixture of isopropanol and water (ratio by volume 9 : 1). Dilution with water produced a milky emulsion (pH value 7.4) which did not settle out, but remained stable.

(b) to (g) Changes in the molar ratios of amine component to acid component

The molar ratios of amine component to acid component were changed as shown in Table 1 below, the amine used and the carboxylic acid used being identical with those shown in Example 1a.

EXAMPLES 2 to 21

Fabric softeners according to the invention were prepared from the components shown in Table 1 below in the same manner as in Example 1a, except the reaction was carried out in organic solvent. The molar ratio of amine component to acid component was 1 : 1 in every Example. The combination of active substances used are shown in Table 1 below.

TABLE 1

| Ex. No. | Formula of amine component | Acid Component | Molar ratio |
|---|---|---|---|
| 1a | II; $R^1 = n\text{-}C_{16}H_{33}$; $R^3 = R^4 = CH_3$ | lauric acid | 1:1 |
| b | II; $R^1 = n\text{-}C_{16}H_{33}$; $R^3 = R^4 = CH_3$ | lauric acid | 0.25:1 |
| c | II; $R^1 = n\text{-}C_{16}H_{33}$; $R^3 = R^4 = CH_3$ | lauric acid | 0.50:1 |
| d | II; $R^1 = n\text{-}C_{16}H_{33}$; $R^3 = R^4 = CH_3$ | lauric acid | 0.75:1 |
| e | II; $R^1 = n\text{-}C_{16}H_{33}$; $R^3 = R^4 = CH_3$ | lauric acid | 1.33:1 |
| f | II; $R^1 = n\text{-}C_{16}H_{33}$; $R^3 = R^4 = CH_3$ | lauric acid | 2.0:1 |
| g | II; $R^1 = n\text{-}C_{16}H_{33}$; $R^3 = R^4 = CH_3$ | lauric acid | 4.0:1 |
| 2 | II; $R^1 = n\text{-}C_{12}H_{25}$; $R^3 = R^4 = CH_3$ | stearic acid | 1:1 |
| 3 | II; $R^1 = n\text{-}C_{12}H_{25}$; $R^3 = R^4 = CH_3$ | lauric acid | 1:1 |
| 4 | II; $R^1 = n\text{-}C_{12}H_{25}$; $R^3 = R^4 = H$ | isopalmitic acid | 1:1 |
| 5 | II; $R^1 = n\text{-}C_{18}H_{37}$; $R^3 = R^4 = H$ | isopalmitic acid | 1:1 |
| 6 | II; $R^1 = n\text{-}C_{18}H_{37}$; $R^3 = R^4 = CH_3$ | formic acid | 1:1 |
| 7 | I; $R^1 = R^2 = H$; $R^3 = CH_3$; $R^4 = CH_2—CH_2OH$; $p = 14$; $q = 0$ | lauric acid | 1:1 |
| 8 | I; $R^1 = R^2 = H$; $R^3 = CH_3$; $R^4 = CH_2—CH_2OH$; $p = 14$; $q = 0$ | stearic acid | 1:1 |
| 9 | I; $R^1 = H$; $R^2 = OH$; $R^3 = H$; $R^4 = CH_2—CH_2—OH$; $p = 8$; $q = 8$ | lauric acid | 1:1 |
| 10 | I; $R^1 = H$; $R^2 = OH$; $R^3 = H$; $R^4 = CH_2—CH_2OH$; $p = 8$; $q = 8$ | stearic acid | 1:1 |
| 11 | amine of Example 1, quaternized with $CH_3Cl$[1] | stearic acid | 1:1 |
| 12 | amine of Example 1, quaternized with $CH_3Cl$[1] | palmitic acid | 1:1 |
| 13 | amine of Example 1, quaternized with $CH_3Cl$[1] | lauric acid | 1:1 |
| 14 | I; $R^1 = R^2 = H$; $R^3 = CH_3$; $R^4 = CH_2CH_2OH$; $p = 14$; $q = 0$; quaternized with $CH_3Cl$[2] | stearic acid | 1:1 |
| 15 | I; $R^1 = R^2 = H$; $R^3 = CH_3$; $R^4 = CH_2CH_2OH$; $p = 14$; $q = 0$; quaternized with $CH_3Cl$[2] | palmitic acid | 1:1 |
| 16 | I; $R^1 = R^2 = H$; $R^3 = CH_3$; $R^4 = CH_2CH_2OH$; $p = 14$; $q = 0$; quaternized with $CH_3Cl$[2] | lauric acid | 1:1 |
| 17 | amine of Example 1, quaternized with $C_2H_5Cl$ | palmitic acid | 1:1 |
| 18 | I; $R^1 = R^2 = H$; $R^3 = R^4 = CH_3$; $p = q = 0$ | stearic acid | 1:1 |
| 19 | I; $R^1 = R^2 = H$; $R^3 = R^4 = CH_3$; $p = q = 0$ | isopalmitic acid | 1:1 |
| 20 | I; $R^1 = R^2 = H$; $R^3 = R^4 = CH_3$; $p = q = 0$ | techn. oleic acid | 1:1 |
| 21 | I; $R^1 = R^2 = H$; $R^3 = R^4 = CH_3$; $p = q = 0$ | soya oil | 1:1 |

Remarks:
[1]Commercially obtainable as "Dehyquart"
[2]Commercially obtainable as "Dehyquart"

EXAMPLE 22

To test their fabric-softening properties, the active substances of Examples 1 to 21 were dispersed in water. The active substance concentration of the fabric softeners according to the invention was 0.3 g per liter water.

Cotton terry fabric which had been treated with a solution of 4 g sodium tripolyphosphate per liter water for 96 hours beforehand and which was extremely hard, was contacted with the above dispersions for 5 minutes. The treatment liquor was then separated off by centrifuging for 10 seconds.

After drying, the terry samples were tested for softness by comparison with the hard starting material by examiners experienced in the evaluation of fabric softness. The test was based on an evaluation scale in which the values can vary from 0 (very hard feel) to 6 (very soft feel).

In a "double determination", two fabrics were treated with the fabric softener to be tested; in a "triple determination", three fabrics were correspondingly treated and tested.

The values are shown in Table 2 below.

EXAMPLE 23

In order further to test and evaluate the fabric softeners according to the invention, molleton cloths were treated for 20 hours with an aqueous sodium tripolyphosphate solution in the same way as described in Example 22. Thereafter the cloths were extremely hard. Softness evaluation was carried out in the same way as in Example 22, the results being shown in Table 2 below.

EXAMPLE 24

For further evaluation of the fabric-softening properties of the fabric softeners according to the invention, prewashed terry cloths which had not been treated with sodium tripolyphosphate were treated with the fabric softeners according to the invention and then evaluated for softness in the same way as in Examples 22 and 23. The results are shown in Table 2 below.

TABLE 2

Results of the softness evaluation of fabrics treated with the fabric softeners according to the invention

| Fabric softener of Example No. | Feel Marks Hardened terry (Ex. 22) | Hardened molleton (Ex. 23) | Prewashed terry (Ex. 24) | $X^1$ |
|---|---|---|---|---|
| 1a | 4.1 | 4.2 | 4.2 | 4.1 |
| b | 4.2 | 3.6 | 3.3 | 3.8 |
| c | 4.2 | 4.2 | 4.2 | 4.1 |
| d | 4.3 | 4.7 | 4.5 | 4.5 |
| e | 4.0 | 4.0 | 4.3 | 4.1 |
| f | 4.0 | 4.2 | 4.3 | 4.1 |
| g | 3.9 | 4.3 | 4.1 | 4.1 |
| 2 | 2.6 | 3.3 | 3.1 | 3.0 |
| 3 | 3.0 | 3.3 | 3.6 | 3.3 |
| 4 | 3.0 | 3.6 | 3.4 | 3.3 |
| 5 | 3.2 | 3.1 | 3.1 | 3.1 |
| 6 | 4.0 | 4.1 | 4.0 | 4.0 |
| 7 | 4.6 | 4.5 | 4.8 | 4.6 |
| 8 | 4.7 | 4.8 | 4.8 | 4.7 |
| 9 | 3.1 | 2.4 | 3.2 | 2.9 |
| 10 | 3.6 | 2.6 | 3.3 | 3.1 |
| 11 | 4.6 | 4.2 | 4.3 | 4.3 |
| 12 | 4.7 | 3.5 | 4.4 | 4.1 |
| 13 | 3.5 | 2.5 | 3.1 | 3.0 |
| 14 | 4.8 | 5.0 | 4.0 | 4.6 |
| 15 | 5.3 | 4.8 | 4.8 | 4.9 |
| 16 | 3.8 | 3.5 | 3.0 | 3.4 |
| 17 | 2.6 | 3.3 | 4.2 | 3.3 |
| 18[2] | — | — | — | — |
| 19 | 2.3 | 2.5 | 2.0 | 2.2 |
| 20 | 2.0 | 1.9 | 2.0 | 1.9 |
| 21 | 1.6 | 1.0 | 1.4 | 1.6 |

Remarks:
[1]Mean value of the three evaluations
[2]Fabric softener was not dispersible in water; no evaluation possible

RESULT

As can be seen from the results of the feel tests shown in the form of the average values of all the measurements in Table 2, column 5, the treated fabrics are extremely fluffy and very soft after drying. In addition, the absorbency of the treated fabrics after drying was unaffected compared with the untreated state.

The active-substance combinations of Examples 1a, 11, 14 and 15 are particularly effective in the context of the invention. Using the components shown in Table 1, therefore, it is possible to obtain fabric softeners according to the invention which provide the treated fabrics with a particularly high degree of softness It is to be understood that the above described embodiments of the invention are illustrative only and that modifications throughout may occur to those skilled in the art. Accordingly, this invention is not to be regarded as limited to the embodiments disclosed herein, but is to be limited as defined by the appended claims.

We claim:

1. An aqueous fabric softener composition comprising a mixture of:

(A) at least one amino compound selected from the group consisting of compounds having the general formula:

(1)

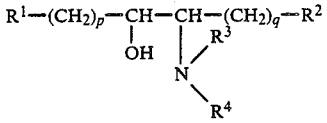

and mixtures of such compounds;

(2) $R^1R^3R^4N$ and mixtures of such compounds;

(3) quaternary ammonium compounds of (1) and/or (2), and mixtures of such compounds; and (4) mixtures of two or more of (1), (2) and (3);

wherein:

$R^1$ and $R^2$ may be the same or different and, independently of one another, are selected from the group consisting of hydrogen and straight or branched chain $C_1$–$C_{20}$ alkyl radicals and $R^2$ may in addition be selected from the group consisting of a hydroxy group and a group corresponding to the following formula:

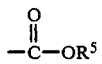

wherein:

$R^5$ is hydrogen or a straight or branched chain $C_1$–$C_6$ alkyl radical; and $R^3$ and $R^4$ may be the same or different and, independently of one another, are selected from the group consisting of hydrogen, straight or branched chain $C_1$–$C_6$ alkyl radicals, and hydroxyalkyl radicals containing from 1 to 6 carbon atoms in the straight-chain alkyl radical; and p and q are numbers of from 0 to 22, the sum (p+q) being in the range from 0 to 22;

(B) at least one straight or branched chain saturated or unsaturated $C_1$–$C_{24}$ carboxylic acid, and mixtures of such acids; and (C) water 2. The fabric softener of claim 1 wherein the molar ratio of component A to component B is within the range of about 10 to 90 mole percent of A to about 90 to 10 mole percent of B respectively.

3. The fabric softener of claim 2 wherein components A and B are present at a level of at least about 2% by weight, and containing at least about 50% by weight water.

4. The fabric softener of claim 1 wherein the amino compound is A-(1) and $R^1$ and $R^2$ are hydrogen, $R^3$ and $R^4$ are straight-chain $C_1$–$C_3$ alkyl radicals or hydroxyalkyl radicals containing from 1 to 3 carbon atoms in the linear alkyl radical, p is a number from 8 to 18 and q is O.

5. The fabric softener of claim 4 wherein $R^3$ and $R^4$ are methyl or ethyl radicals or hydroxyethyl radicals and p is a number of from 10 to 16.

6. The fabric softener of claim 1 wherein the amino compounds is A-(1) and $R^1$ is a straight-chain $C_1$–$C_3$ alkyl radical and $R^2$ is a carbonyloxymethyl group.

7. The fabric softener of claim 6 wherein $R^3$ and $R^4$ are straight-chain $C_1$–$C_3$ alkyl radicals or hydroxyalkyl radicals containing from 1 to 3 carbon atoms in the linear alkyl radical, q is 0 and p is a number of from 8 to 18.

8. The fabric softener of claim 7 wherein $R^3$ and $R^4$ independently of one another represent methyl or ethyl radicals or hydroxyethyl radicals and p is a number of from 10 to 16.

9. The fabric softener of claim 1 wherein the amino compound is A-(2) and $R^1$ is a $C_{12}$–$C_{20}$ alkyl radical.

10. The fabric softener of claim 9 wherein $R^1$ is a $C_{14}$–$C_{18}$ alkyl radical.

11. The fabric softener of claim 1 wherein the amino compound is A-(3) prepared by quaternization with a compound corresponding to the following general formula:

$$(R^6)_mX$$

wherein:

$R^6$ is a straight or branched chain $C_1$–$C_4$ alkyl radical or phenalkyl radical containing 1 or 2 carbon atoms in the alkyl radical;

X is the acid residue of a chloride, bromide, methosulfate, ethosulfate, toluene sulfate, sulfate, acetate, lactate, phosphate or benzoate and m is the valency of the acid residue X.

12. The fabric softener of claim 11 wherein the quaternization compound is selected from the group consisting of methyl chloride, ethyl chloride, benzyl chloride and dimethyl sulfate.

13. The fabric softener of claim 1 wherein carboxylic acid component B is a straight-chain, saturated or unsaturated $C_1$–$C_{24}$ carboxylic acid or a mixture of such acids.

14. The fabric softener of claim 13 wherein the carboxylic acid component is a linear, saturated $C_8$–$C_{18}$ carboxylic acid or a mixture of such acids.

15. The fabric softener of claim 13 wherein the carboxylic acid component is a carboxylic acid of soybean oil, linseed oil, sunflower oil, coconut oil, palm oil, tallow or mixtures thereof.

16. The fabric softener of claim 1 wherein the molar ratio of component A to component B is within the range of about 0.75 to 4 : 1.

17. The fabric softener of claim 16 wherein said molar ratio is in the range of about 1 : 1.

18. A method for softening fabrics comprising immersing said fabric in a dilute aqueous solution of the fabric softener composition of claim 1, and drying said fabric.

19. The method of claim 18 wherein said dilute aqueous solution contains said fabric softener composition at a concentration of about 0.1 to about 0.6% by weight.

* * * * *